United States Patent [19]

Sluys

[11] 4,321,882

[45] Mar. 30, 1982

[54] INTERCONNECTING SYSTEM FOR MARINE FLOATS

[75] Inventor: Wesley W. Sluys, Bellingham, Wash.

[73] Assignee: Builders Concrete, Inc., Bellingham, Wash.

[21] Appl. No.: 120,368

[22] Filed: Feb. 11, 1980

[51] Int. Cl.[3] ..... B63B 35/00

[52] U.S. Cl. ..... 114/266

[58] Field of Search ..... 114/263, 267, 266, 219, 114/230

[56] References Cited

U.S. PATENT DOCUMENTS

| | | | |
|---|---|---|---|
| 1,821,320 | 9/1931 | Plummer | 114/267 X |
| 3,060,884 | 10/1962 | Wood | 114/230 |
| 3,977,344 | 8/1976 | Holford | 114/263 |
| 4,134,610 | 1/1979 | Lindewall | 114/219 X |
| 4,223,629 | 9/1980 | Dunlop | 114/263 |

FOREIGN PATENT DOCUMENTS

| | | | |
|---|---|---|---|
| 2000757 | 7/1971 | Fed. Rep. of Germany | 114/267 |

*Primary Examiner*—Trygve M. Blix
*Assistant Examiner*—John C. Paul
*Attorney, Agent, or Firm*—Seed, Berry, Vernon & Baynham

[57] ABSTRACT

A fastening system for interconnecting a row of marine floats while allowing relative movement of the floats resulting from wave action. One or more chains, cables or other securing lines extend through the floats from one end of the row to the other. The securing lines pass through recesses formed in adjacent end walls of the floats. A resilient member having a central bore is inserted into the recesses with the securing line passing through the bore. The resilient member absorbs longitudinal forces imparted to the floats. It also restricts transverse vertical and horizontal movement of the floats with respect to each other while allowing pivotal movement of the floats. A metal tube preferably lines the bore to prevent the securing line from abrading the resilient member and to increase the shear strength of the resilient member. The recesses may also be lined with a frame, and the frames of two or more recesses in a given end wall may be interconnected for additional strength. The ends of the securing lines may be fastened to respective floats at the ends of the row, and one of the ends may be connected to a weight hanging from a float to tension the securing line. The floats and resilient members loosely surround the securing line so that individual resilient members and the securing line can be easily replaced at any time.

16 Claims, 8 Drawing Figures

INTERCONNECTING SYSTEM FOR MARINE FLOATS

BACKGROUND OF THE INVENTION

1. Field of the Invention

This invention relates to vessel moorages and floating breakwaters formed by interconnected marine floats, and more particularly to a system for securing a row of marine floats to each other in relatively rough waters.

2. Description of the Prior Art

Vessel moorages constructed of a large number of interconnected marine floats, generally of concrete, are in common use throughout the United States and other countries. The floats are generally rigid, and the fastening structure for interconnecting individual floats must be sturdy enough to withstand typically rough seas, yet allow pivotal movement between the floats responsive to wave action.

Marine floats are typically interconnected utilizing three distinctly different fastening systems. In one of these systems, the floats are provided with transversely extending tie rods having threaded ends projecting from the sides of the floats. Elongated members or "wales" extending along the sides of the floats are secured to the tie rod ends by nuts threaded onto the tie rod ends. In practice, pairs of wales are generally used in overlapping fashion so that they form a continuous structural member extending along each side of the row of marine floats. This system has many advantageous properties, but it is unacceptable under some circumstances as discussed in greater detail below.

A second commonly used interconnecting hinge system employs various types of fasteners which are attached to the ends or embedded in the float. The embedded or attached fastener for one float is then connected to the embedded fastener of the adjacent float by a flexible or pivoting member which allows the floats to pivot with respect to each other.

The third type of marine float used employs tensioning cables or bars that pass lengthwise through float modules with rubber pads being placed between the float modules as a cushion.

Any of the above described conventional fastening structures can be advantageously used where the moorage is protected by land masses or breakwaters, or where the weather is not particularly severe. However, with the increasing demand for moorage facilities, naturally protected sites are becoming less available. Thus, it is necessary to turn to alternative sites which are often unprotected and thus encounter substantially rougher seas. Furthermore, such alternative sites are often in deeper waters making artificial protective structures such as breakwaters more expensive, sometimes prohibitively so, to construct.

The conventional structures for interconnecting marine floats are often incapable of withstanding the rougher seas encountered at these alternative moorage sites. Interconnecting systems employing wales or post-tension cables or bars do not allow sufficient pivoting action of the floats with respect to each other when fairly large waves are encountered. As a result, the wales sometimes break or the tie rods are pulled out of the floats, or the prestress or post-tension tendons give way. Embedded or attached fasteners, on the other hand, do allow sufficient pivotal movement between floats, but they are often not embedded in the float with sufficient strength and thus sometimes pull loose. Any of these mishaps to marine floats utilizing conventional interconnecting systems are extremely costly because of the damage done to the floats themselves as well as the damage done to vessels secured to the floats.

SUMMARY OF THE INVENTION

It is an object of the invention to provide a system for interconnecting a row of marine floats which is substantially stronger than presently existing systems.

It is another object of the invention to provide a high strength marine float interconnecting system which allows the floats to pivot with respect to each other.

It is still another object of the invention to provide an interconnecting system for marine floats in which worn or broken portions can be easily and quickly replaced while allowing continual reuse of the marine floats.

It is a further object of the invention to provide an interconnecting system of the character described which is fabricated principally of standard, commercially available components.

These and other objects of the invention are provided by one or more securing lines extending longitudinally through a row of marine floats with the ends of the line fastened to respective floats at the ends of the row. A recess is formed in each end wall of the floats through which the securing line passes. A resilient member having a shape which corresponds to the shape of the recess is received within adjacent recesses so that it bridges the gap between adjacent end walls. The resilient members have formed therein a longitudinally extending bore through which the securing line passes. The length of the resilient member is larger than the combined depth of the adjacent recesses so that the resilient members resiliently space the end walls apart from each other. The resilent members have sufficient shear strength to restrict transverse movement of the floats with respect to each other, but they are sufficiently resilient to allow the floats to pivot with respect to each other. The bore of each resilient member may be lined with a tubular member to prevent the securing line from abrading the resilient member and to increase the shear strength of the resilient member. Each of the recesses may be lined with a rigid frame, and multiple frames positioned in each end wall may be interconnected by a rigid member embedded in the float. The ends of the securing line may be terminated in a variety of structures. The ends may be anchored to the float through a turnbuckle which allows the line to be adjusted. Alternatively, one end of the securing line may carry a weight hanging from a pulley which is rotatably mounted on a float at one end of the row. The weight applies a substantially constant tension to the securing line while allowing the floats to pivot to some extent with respect to each other. The securing lines preferably extend through a tubular conduit embedded in the float, and the diameters of the tubular conduit and the bores formed in the resilient members are preferably larger than the diameter of the securing line so that the securing line may be easily withdrawn from the floats for replacement.

DETAILED DESCRIPTION OF THE INVENTION

Figure 1:
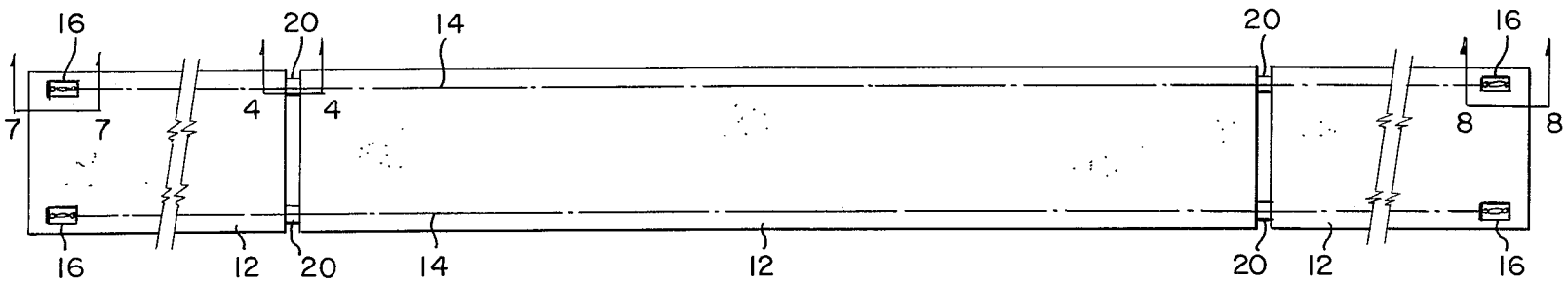
FIG. 1 is a top plan view of a row of marine floats fastened together by the interconnecting system.
Figure 2:
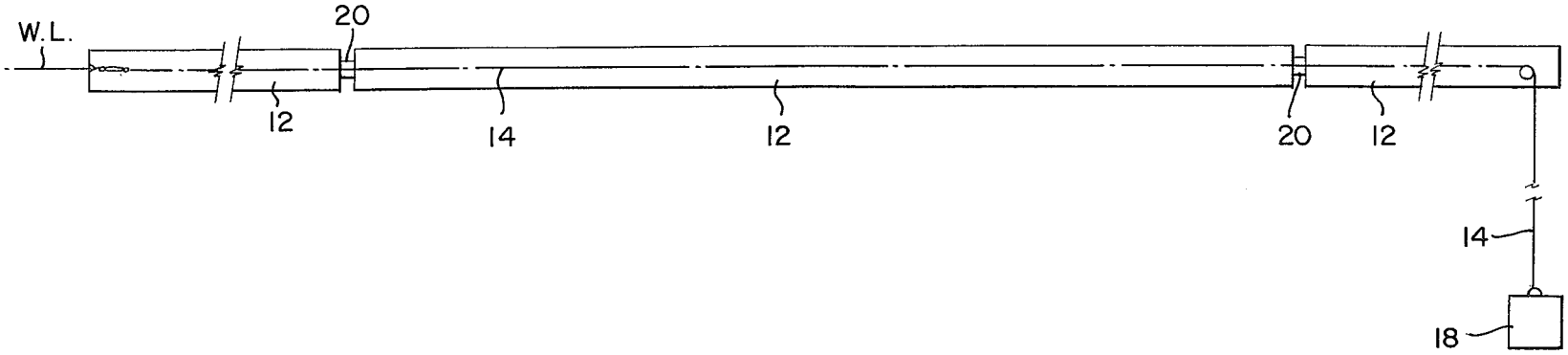
FIG. 2 is a side elevational view of a row of marine floats employing one embodiment of the interconnecting system.

The interconnecting system, as illustrated in FIGS. 1 and 2, secures a plurality of floats 12 to each other. The floats 12 may be of the conventional variety having a concrete casing surrounding a core of buoyant foam or of a heavy duty type used for floating breakwaters. Securing lines 14 of chain, cable, or the like extend longitudinally along opposite sides of the floats 12 and are anchored beneath cover plates 16 as illustrated in greater detail hereinafter. However, as illustrated in FIG. 2, one end of the securing line 14 may carry a weight or anchor 18 which applies a predetermined tension to the line 14 while allowing longitudinal movement of the line 14 through the float 12. The securing line 14 passes through resilient members 20 extending between adjacent end walls of the float 12. The resilient members 20 have sufficient shear strength to prevent excess horizontal or vertical transverse movement of one float 12 with respect to the adjacent float 12. However, they are sufficiently resilient to allow pivotal movement between adjacent floats 12 about either a vertical or horizontal axis responsive to wave action.

Figure 3:
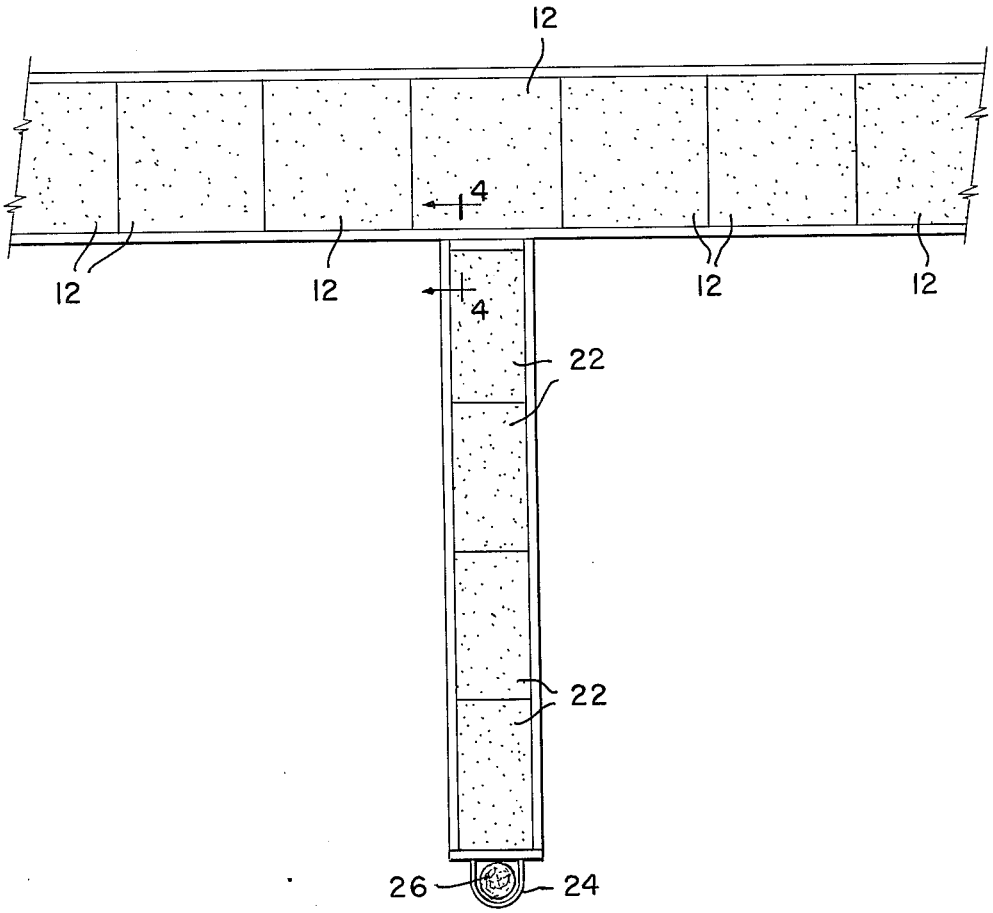
FIG. 3 is a top plan view of a plurality of finger floats secured to a row of mainwalk floats by the inventive interconnecting system.

The inventive interconnection system may also be used to secure a row of finger floats 22 to each other and to a mainwalk float 12 as illustrated in FIG. 3. This structure is substantially identical to the structure illustrated in FIGS. 1 and 2 with the securing line extending through the finger floats 22 and transversely through at least a portion of the mainwalk float 12 from which the finger floats 22 project. The outermost finger float 22 carries a generally U-shaped member 24 which loosely surrounds a pile 26 in a conventional manner.

Figure 4:
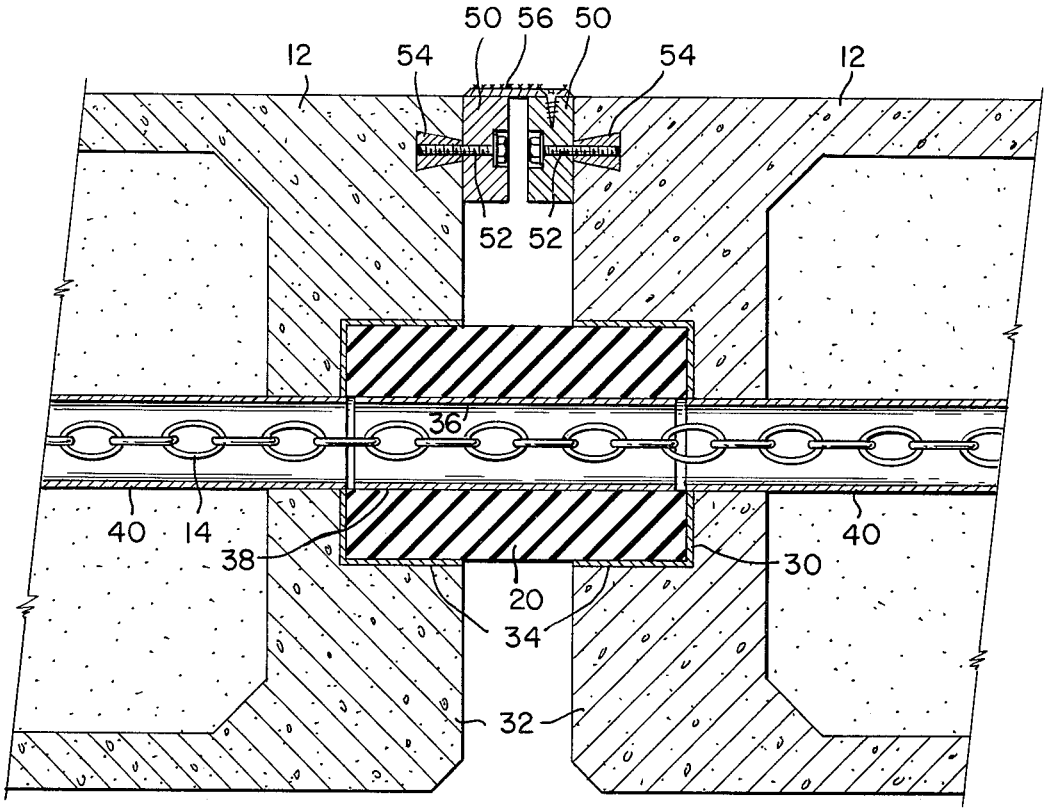
FIG. 4 is a cross-sectional view taken along the line 4—4 of FIGS. 1 and 3, illustrating the interface between the end walls of adjacent floats.
Figure 5:
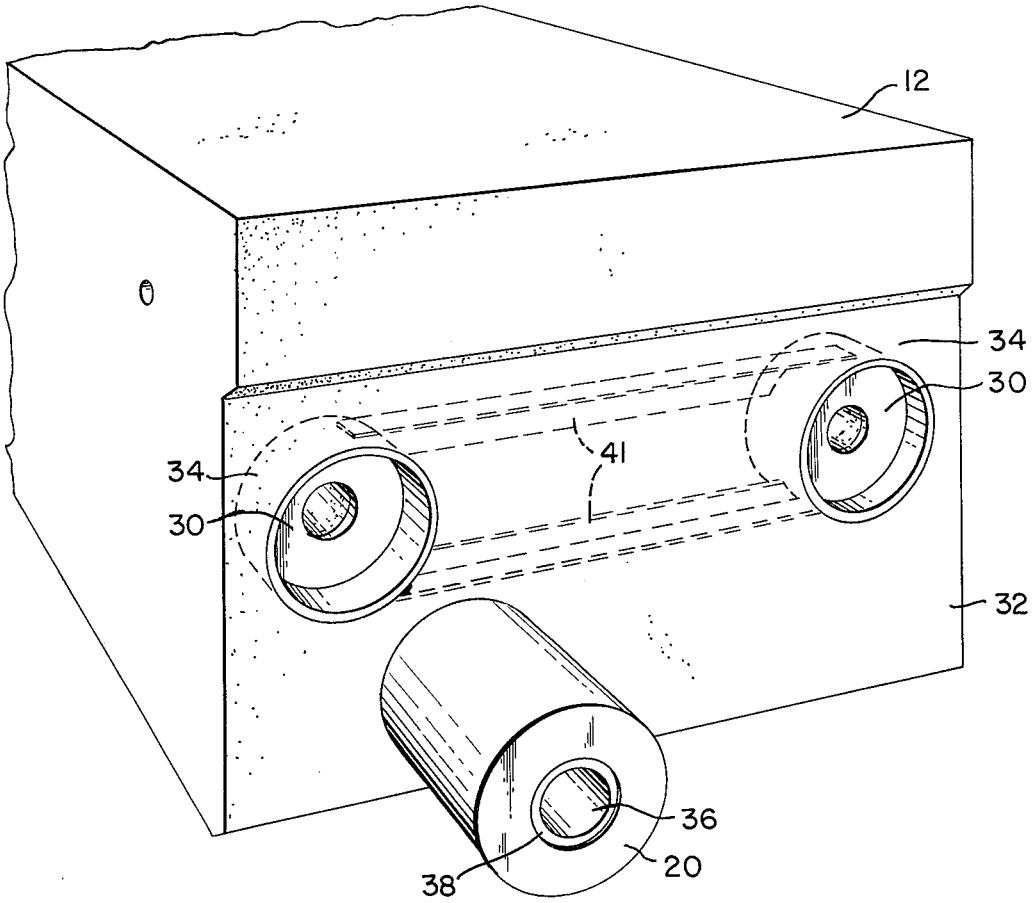
FIG. 5 is an isometric view of an end wall of a marine float illustrating one embodiment of the end wall interface structure.

The interface structure for interconnecting adjacent floats 12,22 is best illustrated in FIGS. 4 and 5. Abutting recesses 30 are formed in adjacent end walls 32 of the floats 12. A frame 34 having a shape conforming to the shape respective recesses 30 align the recesses 30. Opposite ends of the resilient member 20 fit into the frames 34.

The resilient member 20 has formed therein a cylindrical bore 36 through which the securing line 14, which may be a chain as illustrated in FIG. 4, extends. In order to prevent the line 14 from abrading the resilient member 20, the bore 36 may be lined with a rigid tube 38. The tube 38 also places the resilient member 20 in "double shear" to allow the resilient member 20 to better restrict transverse movement of the floats 12 with respect to each other. In other words, both the frame 34 and the tube 38 exert shear stresses on the resilient member 20. The length of the tube 38 is somewhat shorter than the length of the resilient member 20. Consequently, the resilient member 20 longitudinally compresses as longitudinal forces are exerted on the floats 12.

It will also be noted in FIG. 4 that the line 14 passes through a conduit 40 which extends longitudinally through the float 12. The diameters of the tube 38 and conduit 40 should be sufficiently larger than the diameter of the securing line 14 so that the line 14 is free to move within the tube 38 and conduits 40. Consequently the securing line 14 can be easily and quickly replaced at any time. Also, individual resilient members 20 or tubes 38 can be replaced as they become worn or broken.

With particular reference, now, to FIG. 5, a pair of recesses 30 each lined with a frame 34 will generally be formed in each end wall 32 of the floats 12. To maximize the bonding strength between the frames 34 and the float 12, the frames 34 carried in each end wall 32 are preferably interconnected by spaced apart reinforcing members 41. The reinforcing members 41 maximize the side load pull out resistance of the frames 34.

Figure 6:
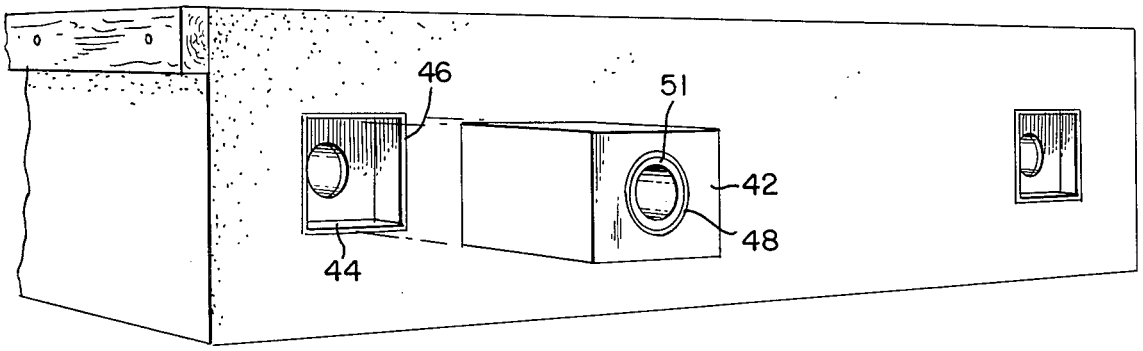
FIG. 6 is an isometric view of an alternative embodiment of the end wall interface structure.

Although cylindrical resilient members, frames 34 and recesses 30 are illustrated in FIGS. 4 and 5, it will be understood that these components can have other shapes as illustrated in FIG. 6. The embodiment of FIG. 6 employs a resilient member 42 having a rectangular cross-section which fits into a rectangularly shaped recess 44 lined with a rectangular frame 46. A cylindrical bore 48 is formed in the rectangularly shaped resilient member 42, and the bore 48 is lined with a cylindrical tube 51.

Returning, once again, to FIG. 4, elongated members or "wales" 50 extend along the upper edge of the end walls 32. The wales 50 are secured to the floats 12 by screws 52 which mate with threaded inserts 54 which are imbedded in the float 12. A cover 56 may be secured to one of the wales 50 with a screw 58. The other wale 50 is unconnected to the cover 56 so that the floats 12 are free to pivot with respect to each other.

Figure 7:
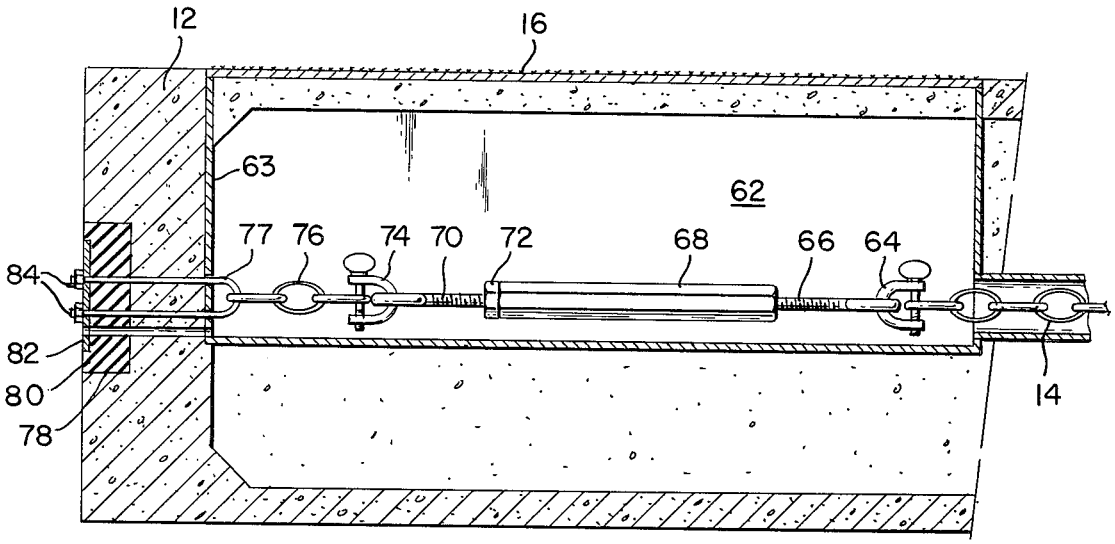
FIG. 7 is a cross-sectional view taken along the line 7—7 of FIG. 1 illustrating one technique for fastening a securing line to an end float.

One technique for fastening both ends of the securing line 14 to the float 12 is illustrated in FIG. 7. The end float 12 is provided with a cover 16 (FIG. 1) which allows access to an opening 62 formed in the float. The opening 62 is surrounded by a rigid liner 63. The end of the securing line 14, which may be a chain as illustrated in FIG. 7, enters the opening 62 and is releasably secured to a conventional shackle 64. The U-shaped portion of the shackle 64 is connected to a conventional eye bolt 66 which mates with a conventional turnbuckle 68. The opposite side of the turnbuckle 68 is connected to an anchoring fixture 70 through a second lock nut 72, a shackle 74 and a short length of chain 76. The anchoring fixture 70 includes a U-bolt 77 connected to the chain 76. The ends of the U-bolt 77 extend through a recess 78 which is substantially identical to the recesses 30 of FIGS. 4 and 5 or the recess 44 of FIG. 6. A block of resilient impact absorbing material 80 fills the recess 78 and is held in place by a bearing plate 82 having a pair of holes through which the ends of the U-bolt 77 extend. The U-bolt 77 is secured to the plate 82 by a pair of nuts 84. Utilizing this arrangement gross adjustments in the length of the securing line 14 can be effected by varying the length of the chain 76 or by connecting different lengths of securing line 14 to the shackle 64. Fine adjustments of the securing line length can be effected by rotating the turnbuckle 68 in a conventional manner.

Figure 8:
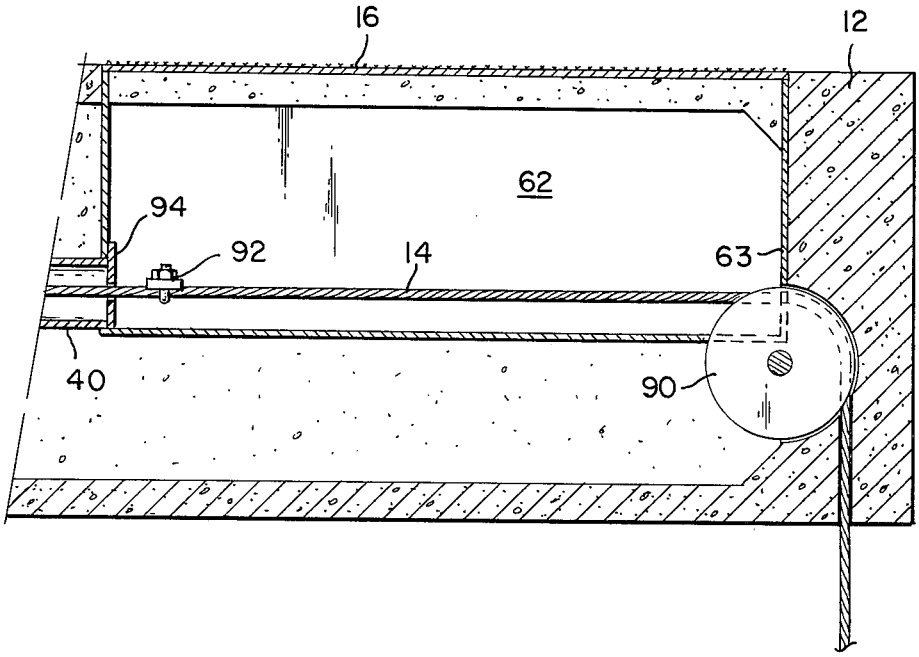
FIG. 8 is a cross-sectional view taken along the line 8—8 of FIG. 1 illustrating one technique for applying a predetermined, relatively constant tension to the securing line.

An alternative embodiment for connecting the securing line 14 to an end float 12 is illustrated in FIG. 8. As with the embodiment of FIG. 7, this structure employs an opening 62 surrounded by a liner 63 and enclosed by a cover 16. The securing line 14 of the embodiment of FIG. 8 is a cable which extends through the longitudinal float conduit 40 to a pulley 90 which is rotatably mounted on the float 12. The securing line 14 engages the pulley 90 and extends downwardly to the weight 18 as illustrated in FIG. 2. The weight 18 applies a predetermined and substantially constant tension to the line 14 thereby allowing the floats 12 to pivot with respect to each other responsive to wave action. In order to limit the length of securing line 14 which can be withdrawn from the float 12, a stop clamp 92 is fastened to the securing line 14. The stop clamp 92 abuts a stop 94 to prevent excessive line 14 from being withdrawn from the end float 12. Without the stop clamp 92 and stop 94, the floats 12 could conceivably move apart from each other to such an extent that the resilient members 20, 42 could be withdrawn from their respective recesses 30, 44. The end float 12 supporting the weight 18 is provided with additional buoyancy to counteract the additional downward force of the weight.

The inventive interconnecting system thus securely fastens a row of marine floats to each other while allowing pivotal movements of the floats with respect to each other responsive to wave action. Furthermore, individual components of the interconnecting system can be easily and quickly replaced as they become worn or broken.

I claim:

1. A system for interconnecting a plurality of marine floats arranged in an elongated row, comprising a pair of transversely spaced securing lines extending longitudinally through said floats with the ends thereof fastened to respective floats at the ends of the said row, said system further including a pair of resilient members received within respective abutting recesses formed in adjacent end walls of said floats having a shape which conforms to the shape of said resilient members, each of said resilient members having a longitudinally extending bore through which one of said securing lines passes, said resilient members having a length which is larger than the combined depth of the recesses formed in adjacent end walls, said floats being free of any rigid interconnection therebetween and any interconnection spaced apart from a transverse axis passing through said securing lines such that said resilient members resiliently space said end walls apart from each other and restrict transverse movement of said floats with respect to each other while allowing said floats to pivot with respect to each other.

2. The interconnecting system of claim 1, wherein the bore of said resilient member is lined with a tubular member to prevent said securing line from abrading said resilient member and to increase the ability of said resilient member to restrict transverse movement of said floats with respect to each other.

3. The interconnecting system of claim 1, further including a rigid frame lining each of said recesses.

4. The interconnecting system of claim 3, wherein a plurality of recesses are formed in each of said end walls with each of said recesses are lined with a rigid frame receiving a resilient member having a bore through which a securing line extends, said frames being interconnected by rigid members embedded in said float to maximize the strength of said interconnecting system.

5. The interconnecting system of claim 1, wherein said securing lines extend through tubular conduits embedded in said floats, said conduits having a diameter larger than the diameter of said securing line thereby allowing free movement of said securing line through said floats to facilitate replacement of said securing line.

6. The interconnecting system of claim 1, wherein one end of said securing line is fastened to the outer end of an end float through a turnbuckle to allow the tension of said securing lines to be adjusted.

7. The interconnecting system of claim 1, wherein one end of said securing lines engages a pulley rotatably mounted on an end float, extends downwardly from said pulley and terminates in a weight for continually applying a predetermined tension to said securing line.

8. The interconnecting system of claim 7, further including means for preventing more than a predetermined length of cable from being withdrawn from said end float.

9. The interconnecting system of claim 1, wherein a pair of securing lines extend along opposite side walls of said floats, and wherein each end wall of said floats includes a pair of said resilient members through which respective securing lines extend.

10. A system for interconnecting a plurality of marine floats arranged in an elongated row, comprising a securing line extending longitudinally through said floats with respective ends fastened to the floats at the ends of said row, said system further including respective abutting recesses formed in adjacent end walls of said floats, a rigid frame lining each of said recesses connected to a rigid load distributing structure in said floats, and a resilient member with ends having a shape conforming to the shape of said recesses, positioned in said frames, said resilient member having a longitudinally extending bore through which said securing line passes, said resilient member having a length which is larger than the combined depth of the recesses formed in adjacent end walls such that said resilient members resiliently space said end walls apart from each other and restrict transverse movement of said floats with respect to each other while allowing said floats to pivot with respect to each other.

11. The interconnecting system of claim 10 wherein the bore of said resilient member is lined with a tubular member to prevent said securing line from abrading said resilient member and to increase the ability of said resilient member to restrict transverse movement of said floats with respect to each other.

12. The interconnecting system of claim 10 wherein a plurality of recesses are formed in each of said end walls, with each of said recesses being lined with a rigid frame receiving one end of a resilient member having a bore through which a securing line extends, said frames being interconnected by rigid members embedded in said float to maximize the strength of said interconnecting system.

13. A system for interconnecting a plurality of marine floats arranged in an elongated row, comprising a securing line extending longitudinally through said floats with respective ends fastened to the floats at the ends of said row, said system further including a resilient member received within abutting recesses formed in adjacent end walls of said floats having a shape which conforms to the shape of said resilient member, said resilient member having a longitudinally extending bore through which said securing line passes, said bore being lined with a rigid tubular member to prevent said securing line from abrading said resilient member and to increase the ability of said resilient member to restrict transverse movement of said floats with respect to each other, said tubular member having a length which is shorter than the uncompressed length of said resilient member so that the ends of said tubular member are spaced apart from the end walls of said recess, thereby allowing said resilient member to be longitudinally compressed, said resilient member having a length which is larger than the combined depth of the recesses formed in adjacent end walls such that said resilient members resiliently space said end walls apart from each other and restrict transverse movement of said floats with respect to each other while allowing said floats to pivot with respect to each other.

14. The interconnecting system of claim 13 wherein the bore of said resilient member is lined with a tubular member to prevent said securing line from abrading said resilient member and to increase the ability of said resilient member to restrict transverse movement of said floats with respect to each other.

15. The interconnecting system of claim 13, further including a rigid frame lining each of said recesses.

16. The interconnecting system of claim 10 wherein a plurality of recesses are formed in each of said end walls, with each of said recesses being lined with a rigid frame receiving one end of a resilient member having a bore through which a securing line extends, said frames being interconnected by rigid members embedded in said float to maximize the strength of said interconnecting system.

* * * * *